US007621715B2

(12) United States Patent
Borderi et al.

(10) Patent No.: US 7,621,715 B2
(45) Date of Patent: Nov. 24, 2009

(54) METHOD AND EQUIPMENT FOR BATCH HANDLING AND TRANSFER OF TOBACCO PRODUCTS

(75) Inventors: Luca Borderi, Sasso Marconi (IT); Gianluca Parisini, Bologna (IT); Valerio Soli, Bologna (IT)

(73) Assignee: G.D. S.p.A., Bologna (IT)

( * ) Notice: Subject to any disclaimer, the term of this patent is extended or adjusted under 35 U.S.C. 154(b) by 658 days.

(21) Appl. No.: 11/478,632

(22) Filed: Jul. 3, 2006

(65) Prior Publication Data

US 2007/0000215 A1 Jan. 4, 2007

(30) Foreign Application Priority Data

Jul. 4, 2005 (IT) ..... BO2005A0450

(51) Int. Cl.
*B65B 69/00* (2006.01)

(52) U.S. Cl. ..... 414/810

(58) Field of Classification Search ..... 131/282; 414/416.05, 416.06, 425, 810; 53/473, 270
See application file for complete search history.

(56) References Cited

U.S. PATENT DOCUMENTS 2,353,736 A * 7/1944 Le Frank ..... 414/411
2,771,202 A * 11/1956 Meyer ..... 414/416.05
2,862,633 A * 12/1958 Stiles ..... 414/416.05
3,626,953 A * 12/1971 Korber et al. ..... 131/282
3,679,079 A * 7/1972 Seragnoli ..... 414/403
4,507,040 A 3/1985 Baese
4,565,203 A * 1/1986 Stewart et al. ..... 131/283
4,744,453 A * 5/1988 Krause et al. ..... 198/347.2
5,263,805 A * 11/1993 Brizzi et al. ..... 414/391
5,464,027 A * 11/1995 Bina et al. ..... 131/283
5,567,104 A * 10/1996 Focke et al. ..... 414/331.01
6,540,061 B1 4/2003 Focke
6,799,577 B2 * 10/2004 Bergo et al. ..... 131/283
6,896,471 B2 * 5/2005 Svyatsky et al. ..... 414/421
6,986,632 B2 * 1/2006 Spatafora et al. ..... 414/421
2007/0000209 A1 * 1/2007 Borderi et al. ..... 53/250

FOREIGN PATENT DOCUMENTS

DE 32 48 454 A1 7/1983
EP 1308101 A1 5/2003

* cited by examiner

*Primary Examiner*—Saúl J Rodríguez
*Assistant Examiner*—Joshua I Rudawitz
(74) *Attorney, Agent, or Firm*—Timothy J. Klima; Shuttleworth & Ingersoll, PLC

(57) ABSTRACT

In a manufacturing system utilizing a cigarette maker linked to a packer, cigarettes temporarily surplus to requirements are stored in containers, each provided with an opening by way of which it can be filled and emptied. A full container is picked up by a first pivoting arm from a magazine and overturned above a bearing surface advancing along a feed direction parallel to this same surface, so as to direct the opening downwards and allow the cigarettes to drop onto the surface. During the step of unloading the cigarettes, the container rests on a hopper and is traversed from a first station toward a second station along a direction parallel and opposite to the feed direction of the bearing surface, so that the cigarettes can be released more quickly from the container. After being emptied, the container is picked up from the second station by a second pivoting arm and put into a magazine with other empty containers.

9 Claims, 14 Drawing Sheets

METHOD AND EQUIPMENT FOR BATCH HANDLING AND TRANSFER OF TOBACCO PRODUCTS

BACKGROUND OF THE INVENTION

The present invention relates to a method and to equipment for the handling and transfer of tobacco products in batches.

The invention finds application to advantage in complete lines for manufacturing tobacco products, cigarettes in particular, and is utilized for the purpose of feeding such products from a maker to a wrapping machine, or packer.

Conventionally, cigarettes are fed to the packer adopting two distinct methods. The first consists in connecting the cigarette maker directly to a hopper of the packer by way of a conveyor, along which the cigarettes are directed en masse. Using the second method, cigarettes emerging from the maker are ordered in containers, known as trays, which are stored in readiness and then emptied at the hopper of the packer when required.

The trays must be emptied at a relatively fast rate, but at the same time with particular care, in order to ensure that the cigarettes will not be disturbed from their orderly arrangement and suffer damage in the process.

To this end, patent EP 1308101 registered in the name of the present applicant discloses a unit for feeding cigars, by which a container to be emptied is positioned with the open top directed downwards onto a supporting surface furnished with an opening smaller than that of the container. The opening presented by the surface is displaced relative to the container in such a way as to restrict the flow of cigars and thus ensure a controlled release.

The unit in question is effective in avoiding damage to the cigars, but cannot sustain a rate of flow sufficient to match the demand of modern cigarette makers and packers, which operate at very high speeds.

The object of the present invention is to provide a method and equipment for batch handling and transfer of tobacco products, such as will be unaffected by the drawback described above.

In particular, the object of the invention is to devise a method and equipment for batch handling and transfer of tobacco products that will be compatible with high speed operation and feed cigarettes at an appreciably high rate of flow.

A further object of the invention is to provide a method and equipment allowing surplus tobacco products to be stored temporarily when the demand at the packer falls below the output from the cigarette maker, and thereafter supplied to the packer when demand exceeds the output of the cigarette maker.

SUMMARY OF THE INVENTION

The stated objects are realized according to the present invention in a method for the batch handling and transfer of tobacco products storable en masse and in ordered arrangement internally of containers, each presenting an opening by way of which it can be filled or emptied, including a step of emptying the containers effected by picking up a container filled with the tobacco products, overturning the container above a bearing surface, in such a way as to direct the opening downwards and allow the products to drop onto the surface, causing the bearing surface to advance along a predetermined feed direction parallel to the selfsame surface, and traversing the container along a direction parallel and opposite to the feed direction of the bearing surface as the container is being emptied, in such a way as to increase the rate of flow at which tobacco products are released from the container.

The aforementioned objects are realized similarly in equipment for batch handling and transfer of tobacco products storable en masse and in ordered arrangement internally of containers, each presenting an opening by way of which it can be filled or emptied, comprising a device by which tobacco products are unloaded from the containers, composed of a bearing surface caused to advance along a predetermined feed direction parallel to the selfsame surface, a first manipulator serving to overturn a full container above the bearing surface in such a way as to direct the opening downwards and allow the products to drop onto the surface, and a carriage capable of movement above the bearing surface between a first station and a second station and designed to displace the container along a direction parallel and opposite to the feed direction of the bearing surface as the tobacco products are unloaded, in such a way as to increase the rate of flow at which tobacco products are released from the container.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
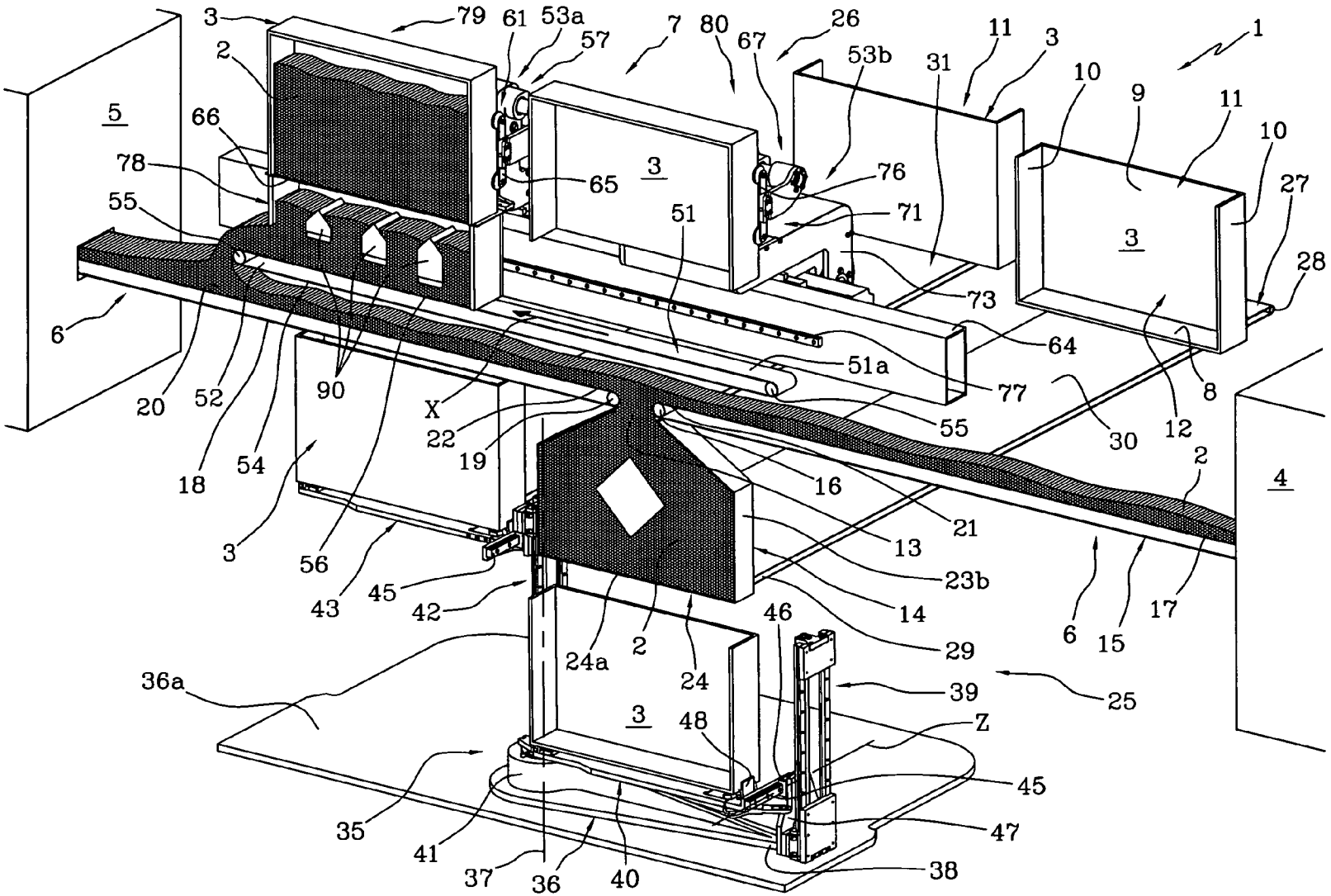
FIG. 1 is an overall front perspective view of equipment embodied in accordance with the present invention.
Figure 2:
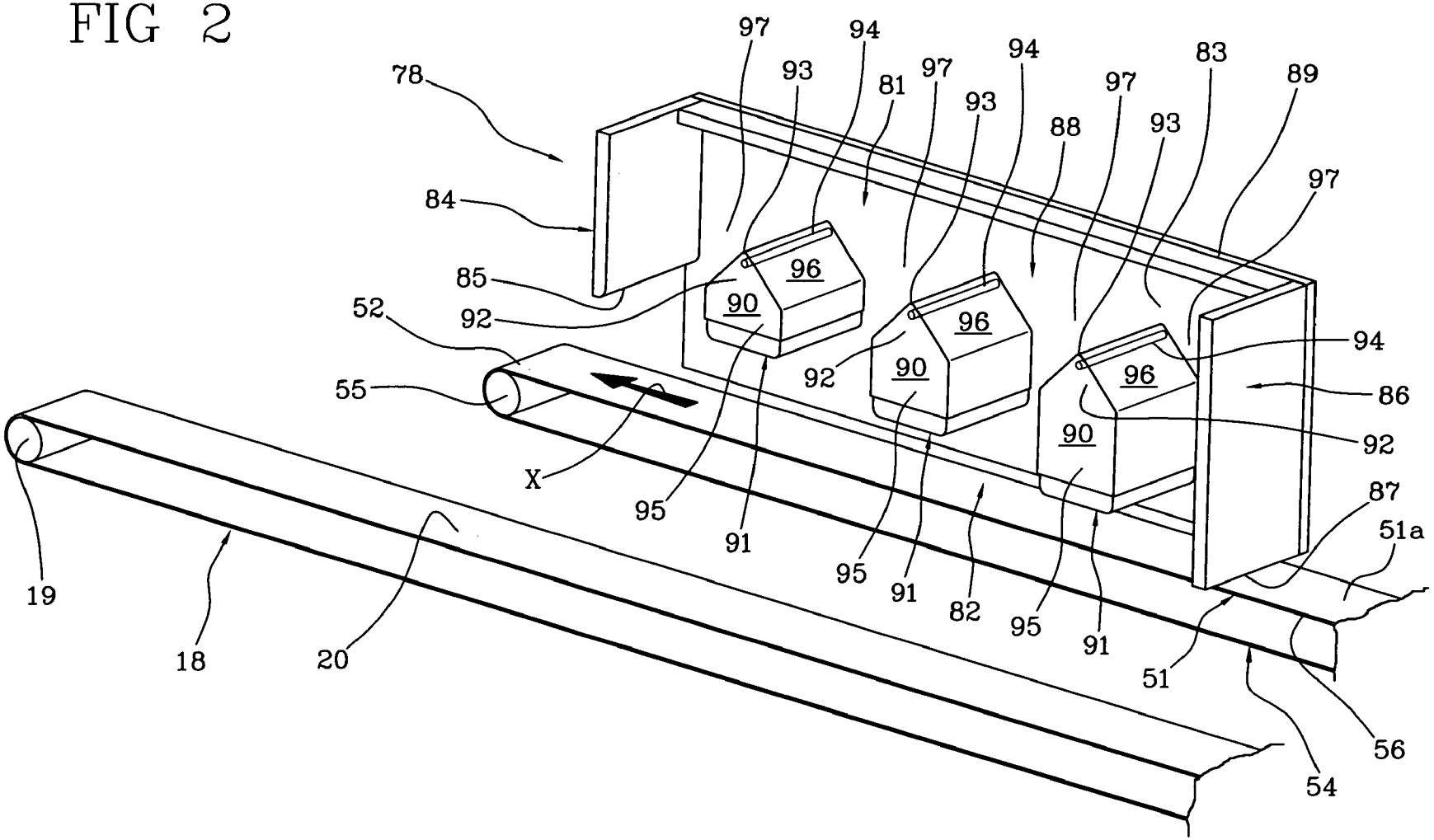
FIG. 2 is an enlarged view showing a first element of the equipment in FIG. 1.
Figure 3:
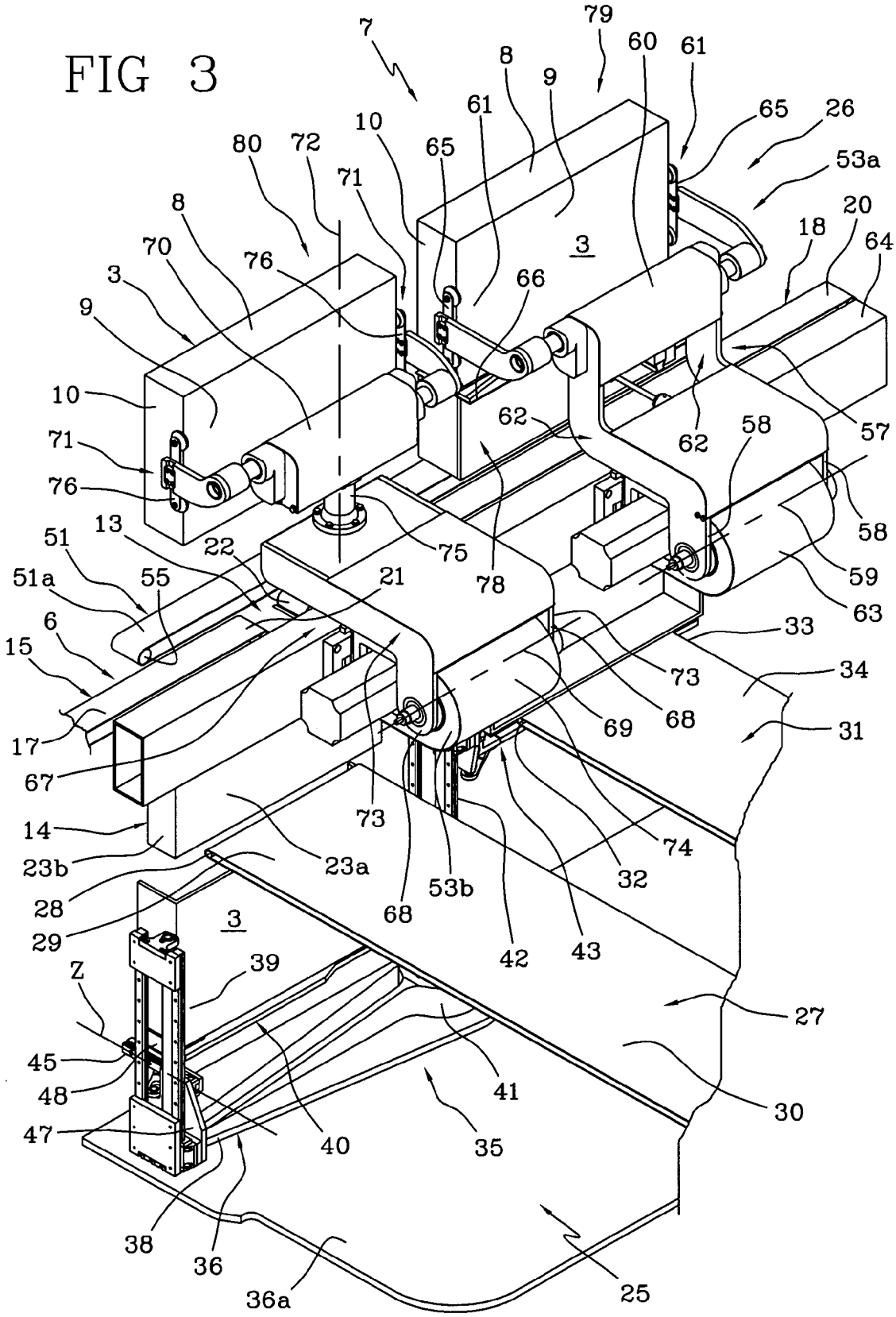
FIG. 3 is a rear perspective view of the equipment illustrated in FIG. 1.

Referring to FIGS. 1, 2 and 3, the invention relates to equipment denoted 1 in its entirety, by which tobacco products 2, cigarettes in particular, are handled in batch mode using containers 3 known as trays, or feedboxes, and transferred thus from a cigarette maker 4 to a cigarette packer 5. Both machines 4 and 5 are of familiar type and therefore illustrated only in schematic outline.

The equipment 1 comprises a main conveyor 6 by which cigarettes 2 are directed from the cigarette maker 4 toward the packer 5; the conveyor 6 operates in conjunction with a unit 7 for managing the movement of the containers 3, each of which is able to hold a plurality of cigarettes 2 arranged in ordered alignment.

Each container 3 presents a rectangular bottom 8, of which the shorter side is matched substantially to the length of a single cigarette 2 and the longer side compasses several tens of cigarettes 2 disposed side by side, also a main wall 9, likewise rectangular, set at right angles to the bottom 8 and joined along one longer side to a corresponding longer side of the bottom 8. The cigarettes 2 lie with one end offered in contact to the main wall 9, which presents a shorter side compassing several tens of cigarettes 2 disposed side by side; thus, the container 3 will accommodate several thousand cigarettes, ordered quincuncially. The container 3 also presents two mutually opposed and parallel side walls 10 perpendicular to the bottom 8 and to the main wall 9, combining to delimit an opening 11 on the side opposite from the bottom 8, through which the container 3 can be filled and emptied, and an auxiliary opening 12 on the side opposite from the main wall 9.

The main conveyor 6 presents a filler opening 13 communicating with a main loading hopper 14, placed beneath the selfsame opening 13, from which empty containers 3 are filled.

In the preferred embodiment illustrated, the main conveyor 6 comprises a first transport belt 15 looped around pulleys 16, extending between the cigarette maker 4 and the hopper 14 and presenting a top branch 17 on which cigarettes 2 emerging from the maker 4 are carried, lying side by side. A second transport belt 18, looped over relative pulleys 19 and aligned in the same plane as that occupied by the first belt 15, extends between the hopper 14 and the cigarette packer 5 and presents a top branch 20 carrying cigarettes 2 about to enter the packer 5. The first and second belts 15 and 18 present respective ends 21 and 22 positioned facing one another and combining to delimit the opening 13 aforementioned.

The hopper 14 comprises a back wall 23*a*, also two side walls 23*b* extending downward divergently from the ends 21 and 22 of the belts 15 and 18 to a distance marginally less than the width of one container 3, and thereafter descending parallel. Each side wall 23*b* is also of width approximately equal to the length of one cigarette 2, so that the hopper 14 presents a bottom discharge opening 24 substantially identical in terms of outline and dimensions to the bottom 8 of a single container 3; the opening 24 is closed by a movable shutter 24*a*.

The container management unit 7 comprises a device 25 by which empty containers 3 are fed to and filled at the loading hopper 14, and by which filled containers 3 are distanced from the hopper, also a device 26 by which cigarettes 2 are unloaded from the full containers 3 onto the main conveyor 6 at a point downstream of the filler opening 13.

In detail, the feeding, filling and distancing device 25 serves to bring empty containers 3 stored in a first magazine 27 to the loading hopper 14, where they will be filled. This first magazine 27 consists in a first belt conveyor looped over respective pulleys 28 and extending transversely to the main conveyor 6. The first belt conveyor 27 terminates at one end 29 adjacent to the loading hopper 14, alongside the bottom opening 24, and is of width less than that of the single container 3. The empty containers 3 are positioned each with the bottom 8 resting on a top branch 30 of the belt conveyor 27, projecting beyond the longitudinal edges of the belt on either side, and with the auxiliary opening 12 facing toward the hopper 14. The first conveyor 27 is capable of movement in two opposing directions so as to carry the containers 3 toward or away from the hopper 14.

The device 25 in question also comprises a second magazine 31 in which containers 3 are placed and stored after being filled at the loading hopper 14. The second magazine 31 consists in a second belt conveyor looped over respective pulleys 32 (one of which shown in FIG. 3), extending parallel with and alongside the first belt conveyor 27 and with one end 33 lying near the corresponding end 29 of the first belt conveyor 27. The second conveyor 31 is capable of movement likewise in two opposing directions and presents a top branch 34 on which the containers 3 are carried, each resting on the bottom 8 with the auxiliary opening 12 facing away from the end 33 of the belt located near the main conveyor 6 (FIGS. 1 and 3).

Finally, the feeding, filling and distancing device 25 comprises a rotary carrier assembly 35 installed at the ends 29 and 33 of the first and second belt conveyors 27 and 31, by which single containers 3 filled at the loading hopper 14 are transferred to the second belt conveyor 31.

Figure 8:
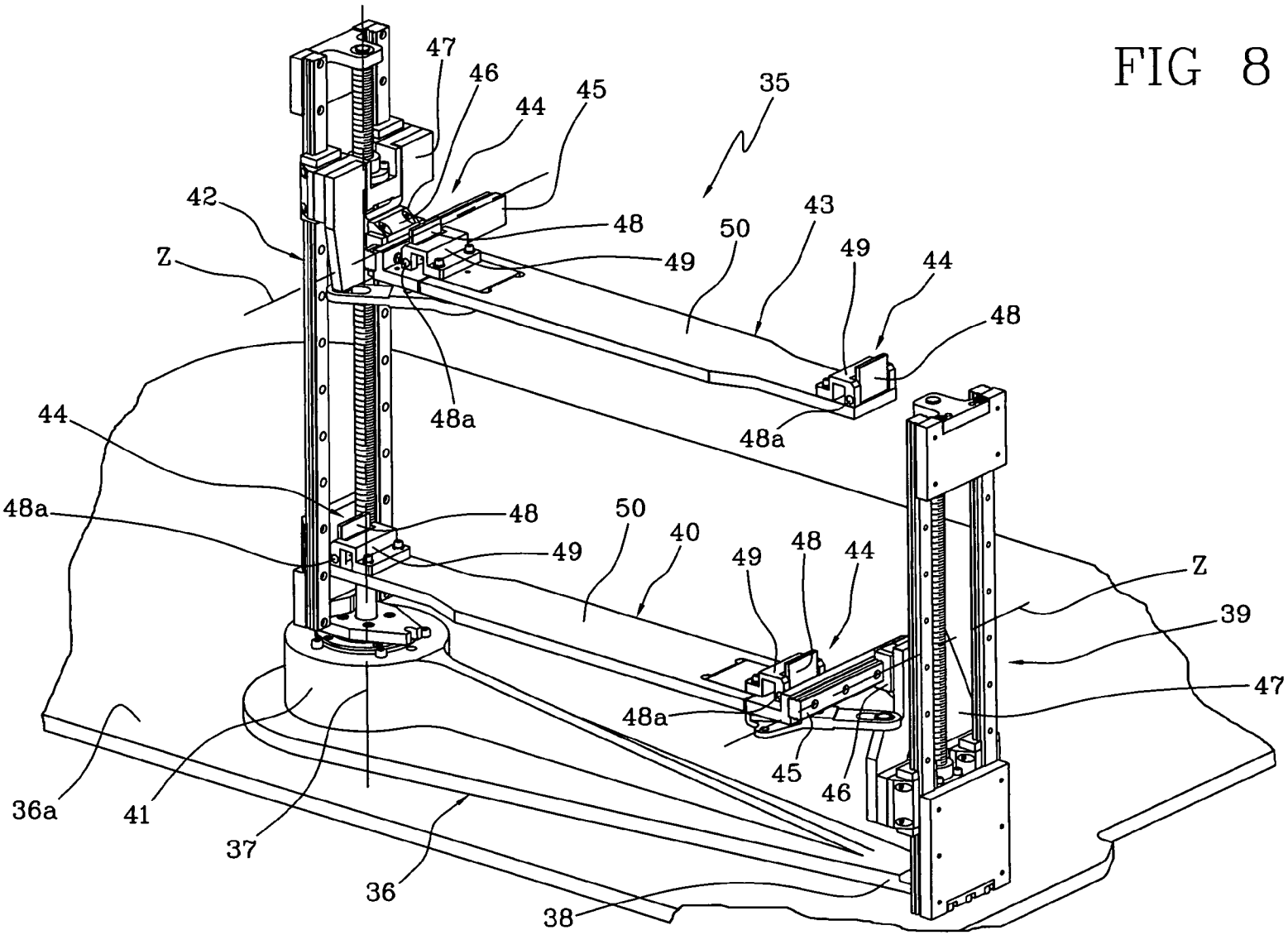
FIG. 8 is an enlarged view showing a second element of the equipment in FIG. 1.

With reference in particular to FIGS. 1 and 8, the rotary carrier assembly 35 lies beneath the aforementioned ends 29 and 33 of the first and second belt conveyors 27 and 31 and comprises a frame 36, mounted on a platform 36*a* and rotatable about a vertical axis 37 located virtually between these same two conveyors. The frame 36 presents an elongated appearance and is equipped at one end 38, the end remote from the fulcrum established by the vertical axis 37, with a first vertical track 39 engaged slidably by a cantilevered first horizontal carrier plate 40 serving to support a respective container 3.

The frame 36 is equipped similarly at a second end 41 with a second vertical track 42 rotatable, relative to the frame, about the vertical axis 37. A second cantilevered horizontal carrier plate 43 is associated slidably with the second track 42. Both plates 40 and 43 can be made thus to rotate independently about the axis 37 and to traverse vertically on the relative tracks 39 and 42 through the agency of suitable motors (not illustrated).

Figure 12:
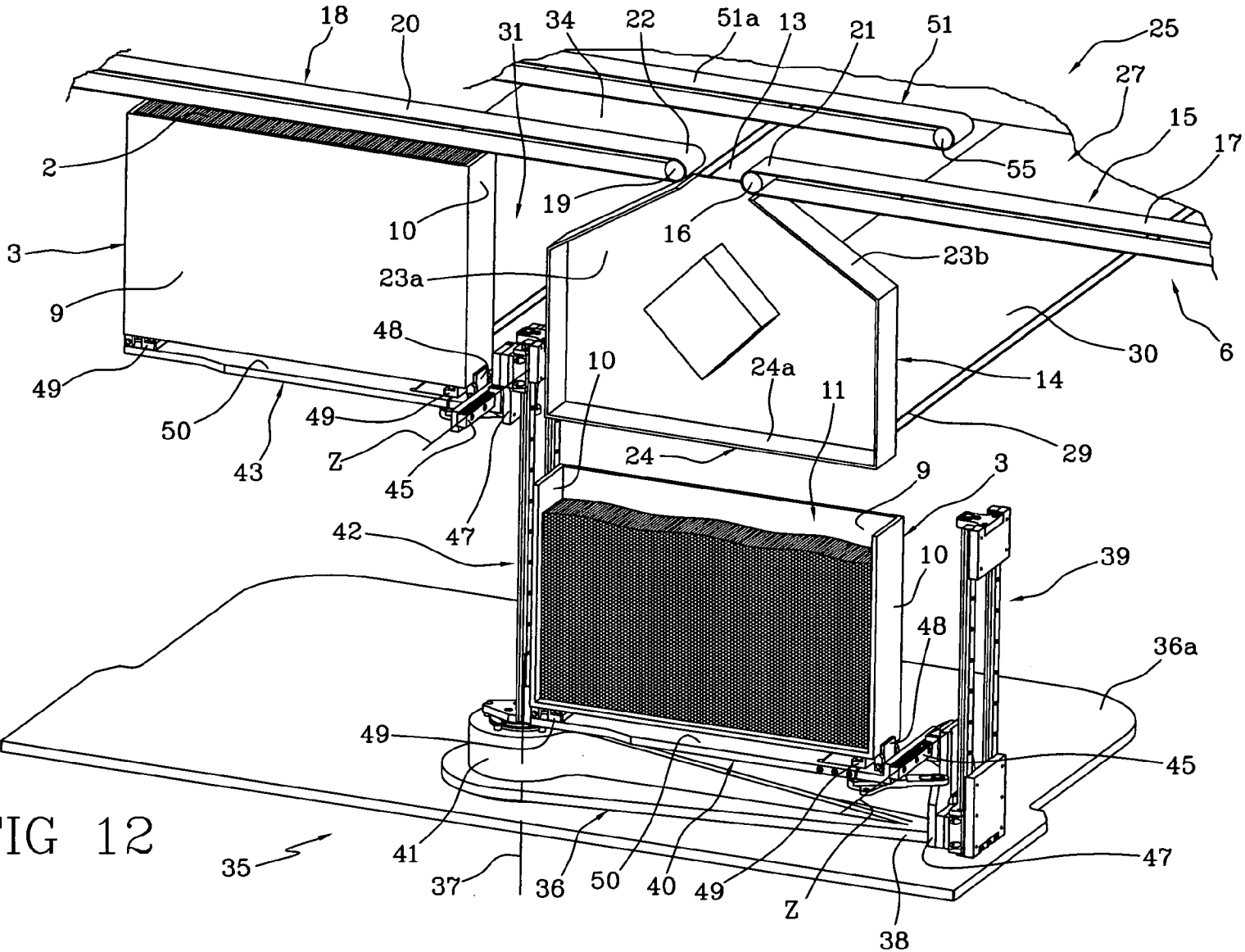
Figure 13:
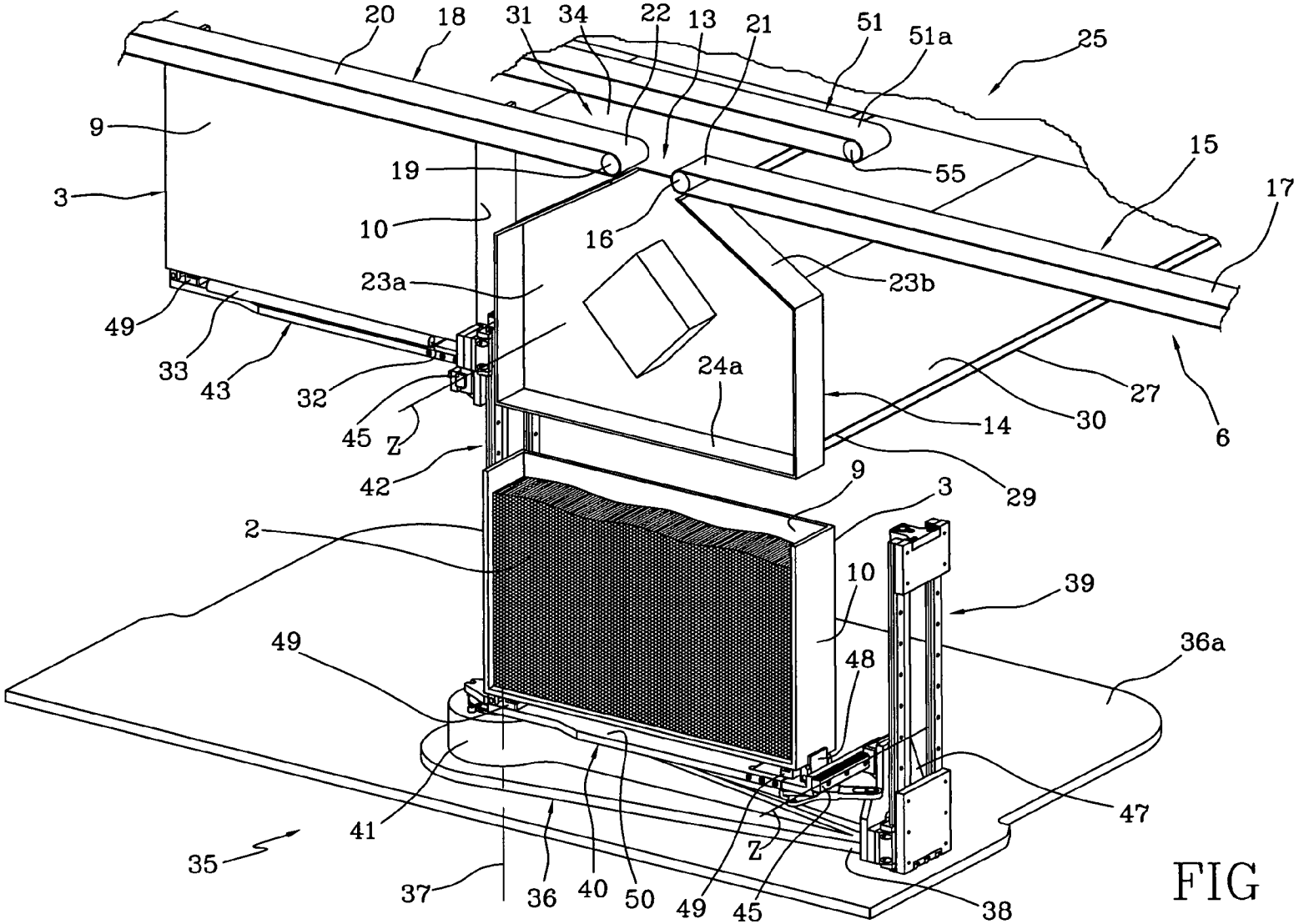

In particular, each carrier plate 40 and 43 is capable of movement between a first position, lying beneath the end 29 of the first belt conveyor 27 (plate 40 on the right in FIG. 9), a second position, associated with the bottom opening 24 of the hopper 14 (plate 40 on the right in FIG. 10), a third position, lying beneath and distanced from the hopper 14 (plate 40 on the right in FIG. 12), a fourth position, lying beneath and distanced from the end 33 of the second conveyor 31 (plate 40 on the left in FIG. 14), a fifth position, lying alongside the end 33 of the second conveyor 31 (plate 43 on the left in FIG. 12), and a sixth position, lying beneath the end 33 of the second conveyor 31 (plate 43 on the left in FIG. 13).

In addition, each horizontal carrier plate 40 and 43 presents gripping means 44 able to lay hold on one of the containers 3 occupying the end 29 of the first belt conveyor 27, when the plate 40 or 43 is in the first position, and place the container 3 on the end 33 of the second belt conveyor 31, when between the fifth and the sixth position.

Looking more closely at the constructional detail of the example illustrated (FIG. 8), the single plate 40 and 43 is joined rigidly to a linear guide member 45 cantilevered in part from the plate 40 and 43 and extending in a horizontal direction Z perpendicular to the longitudinal dimension of the selfsame plate. The linear member 45 slides in a shoe 46, which is mounted in turn to a carriage 47 capable of movement along the respective vertical track 39 and 42, consisting in this instance of two rails. The gripping means 44 comprises a gripper composed of two jaws 48 positioned at opposite ends of the carrier plate 40 and 43, each pivotable on a hinge pin 48*a* disposed parallel to the linear guide member 45 between an open position and a closed position. The single plate 40 and 43 also presents a pair of spacers 49, each mounted adjacent to a relative jaw 48, which are set apart at a distance greater than the width of the belt conveyors 27 and 31 so that the container 3 can be supported and held clear of a top surface 50 presented by the relative plate 40 and 43, in accordance with the method of operation described in due course.

Observing FIGS. 1 to 7, the unloading device 26 will be seen to comprise an auxiliary conveyor 51 that presents a bearing surface 51*a* capable of translational movement along a predetermined feed direction X, with a discharge end 52 lying above the main conveyor 6. The unloading device 26 also comprises a first manipulator 53*a* operating above the feeding, filling and distancing device 25, such as will overturn and position full containers 3 above the bearing surface 51*a* of the auxiliary conveyor 51 with the opening 11 directed toward the selfsame conveyor 51, and a second manipulator 53*b* by which emptied containers 3 are distanced from the auxiliary conveyor 51.

In the preferred embodiment illustrated, the auxiliary conveyor 51 consists in a belt 54 looped around two pulleys 55, extending parallel with and above the main conveyor 6 and straddling the filler opening 13. A top branch 56 of the auxiliary conveyor 51 provides the aforementioned bearing surface 51*a* and is set motion continuously along the same direction as the main conveyor 6, so that the cigarettes 2 are caused to drop onto the top branch 20 of the second transport belt 18.

As illustrated to advantage in FIG. 3, the first manipulator 53*a* comprises a first arm 57 installed above the second belt conveyor 31 and serving to transfer each container 3 filled with cigarettes 2 from this same conveyor 31, that is, from the second magazine storing full containers, to a position above the auxiliary conveyor 51.

The first arm 57 presents a first end 58 hinged about a horizontal axis 59 extending parallel to the feed direction X of the bearing surface 51*a* and that of the main conveyor 6, and a second end 60 equipped with a gripper 61 designed to engage the side walls 10 of a single container 3.

Figure 7:
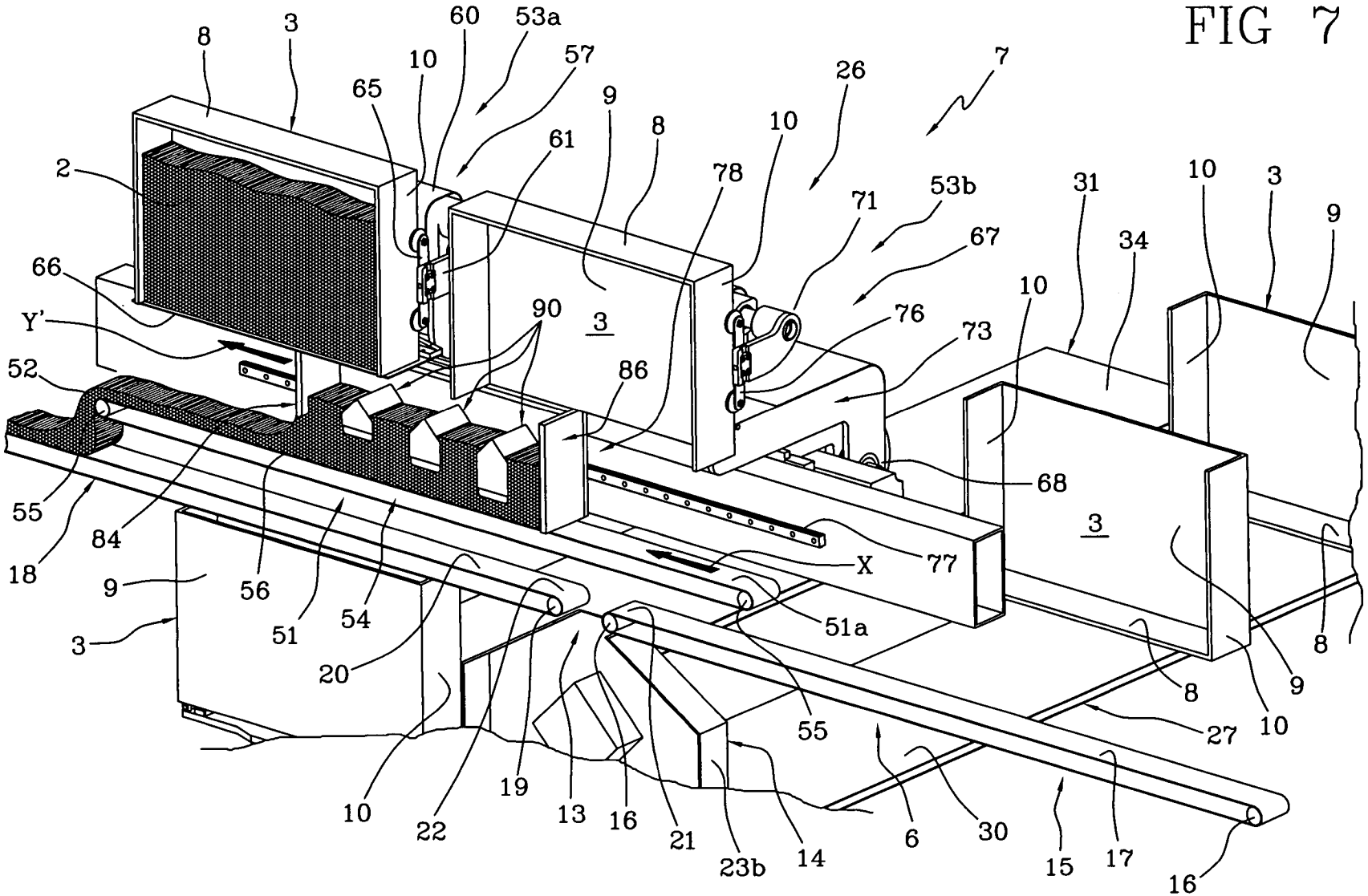

Thus, the first arm 57 is capable of movement between a position allowing a container 3 to be picked up, in which the gripper 61 lies above the second belt conveyor 31 (FIG. 5), and a position allowing cigarettes 2 to be unloaded, in which the gripper 61 lies above the auxiliary conveyor 51 (FIGS. 1, 2 and 7).

In greater detail, the first arm 57 incorporates two plates 62 of "S" outline, parallel with and distanced from one another, set at right angles to the horizontal axis 59 and presenting first ends 58 hinged along this same axis 59 to a mounting 63 stationed above the second belt conveyor 31 and forming part of a frame 64 associated with the equipment 1, illustrated only in part.

Two jaws 65 forming part of the gripper 61 extend from respective second ends 60 of the plates 62 and are capable of movement along a direction parallel to the horizontal axis 59 toward and away from one another so as to grip or release a container 3.

Also attached to the first arm 57 is a closure wall 66 capable of movement between an extended position (FIGS. 1, 3, 5, 6 and 7) of alignment with the gripper 61, in which the opening 11 of the container 3 held between the jaws 65 is closed off, and a retracted position (FIG. 4) set back from the gripper 61, in which the opening 11 of the container 3 is left unobstructed.

In the position where a container 3 is picked up (FIG. 5), the first arm 57 extends cantilevered from the mounting 63 and away from the auxiliary conveyor 51, whereas in the unloading position (FIGS. 1 and 3) the arm 57 extends toward the auxiliary conveyor 51.

The second manipulator 53*b* comprises a pivoting second arm 67 installed above the first belt conveyor 27 and serving to transfer the single containers 3, when empty, from the auxiliary conveyor 51 to the aforementioned conveyor 27, that is to say the magazine storing empty containers.

The second arm 67 presents a first end 68 hinged about a horizontal axis 69 extending parallel to the feed direction X of the bearing surface 51*a* and that of the main conveyor 6, and a second end 70 equipped with a respective gripper 71 designed to engage the side walls 10 of a single container 3; the gripper 71 is also rotatable relative to the second arm 67 about a further axis 72 perpendicular to the horizontal axis 69.

Thus, the second arm 67 is capable of movement between a position allowing a container 3 to be picked up, in which the gripper 71 lies above the auxiliary conveyor 51 (FIGS. 1, 3 and 7), and a position allowing the container 3 to be unloaded onto the magazine 27, in which the gripper 71 lies above the first belt conveyor 27 (FIG. 5), rotated through 180° about its axis 72 from the pick-up position.

In greater detail, the second arm 67 incorporates two plates 73 of "L" outline, parallel with and distanced from one another, set at right angles to the horizontal axis 69 and presenting first ends 68 hinged along this same axis 69 to a mounting 74 stationed above the first belt conveyor 27 and forming part of the frame 64 aforementioned.

A shaft 75 mounted rotatably at a point between the two plates 73 is aligned on the aforementioned axis 72 perpendicular to the horizontal axis 69 and carries two jaws 76 belonging to the gripper 71 of the second arm 67. The jaws 76 are capable of motion along a direction parallel to the horizontal axis 69 toward and away from one another so as to grip or release a container 3.

In the position where a container 3 is picked up (FIGS. 1, 3 and 7), the second arm 67 extends toward the auxiliary conveyor 51, whereas in the unloading position (FIG. 5) the arm 67 extends cantilevered from the mounting 74 in the opposite direction, away from the auxiliary conveyor 51, with the gripper shaft 75 perpendicular to the top branch 30 of the first belt conveyor 27 and the jaws 76 of the gripper 71 directed toward the auxiliary conveyor 51.

The equipment 1 further comprises a rectilinear track 77 located above the auxiliary conveyor 51, fitted to a member of the aforementioned frame 64 and extending parallel to the top branch 56 of the conveyor 51, also a carriage 78 mounted to the track 77, lying above the selfsame top branch 56 of the auxiliary conveyor 51 and consequently above the bearing surface 51*a*. The carriage 78 glides on the track 77, set in motion by suitable means not shown in the drawings, alternating between a first station 79 and a second station 80 located one next to the other on the auxiliary conveyor 51.

As illustrated to advantage in FIG. 2, the carriage 78 consists in a movable hopper presenting a top opening 81 alignable with the opening 11 of the container 3, and a bottom opening 82 offered to the bearing surface 51*a*.

In more detail, the hopper 78 presents a vertical back wall 83 associated with the track 77, by way of a glide for example (not illustrated), a first side wall 84 directed toward the first station 79 and presenting a bottom edge 85 distanced from the bearing surface 51*a*, and a second side wall 86 directed toward the second station 80 and presenting a bottom edge 87 in close proximity to the bearing surface 51*a*.

The side walls 84 and 86 extend parallel from two opposite ends of the back wall 83 and delimit a passage 88 offered to the cigarettes 2 dropping from the container 3, which is set on a top edge 89 of the carriage 78 by the first arm 57 of the first manipulator 53*a* when in the unloading position, with the opening 11 directed toward the passage 88.

With a container 3 positioned on the carriage 78, possibly held in position by retaining means (not illustrated), and the carriage 78 traversing from the first position toward the second position, cigarettes 2 dropping from the container 3 can be distributed along the auxiliary conveyor 51, as will described in due course.

The carriage 78 is also equipped with a plurality of flow dividers 90 mounted to the back wall 83 and occupying the passage 88 filled by the cigarettes 2 dropping from the container 3 onto the auxiliary conveyor 51, of which the function is to separate the cigarettes 2 descending through the hopper 78 into a plurality of ordered streams and ensure they are not turned skew.

As illustrated to advantage in FIG. 2, each flow divider 90 comprises a box-like body 91 with a wedge portion 92 uppermost, hinged along a relative vertex 93 to a pivot 94 extending parallel to the vertex 93 and anchored orthogonally to the back wall 83, and a parallelepiped portion 95 beneath, thereby appearing as a "gabled hut". The descending cigarettes 2 thus slide down inclined surfaces 96 presented by the wedge portions 92, thence through channels 97 delimited by the dividers 90 and by the first side wall 84 and the second side wall 86 of the hopper 78.

Three such flow dividers 90 are shown in the example illustrated, positioned side by side and spaced apart one from the next so as to combine with the side walls 84 and 86 of the carriage 78 in defining four flow channels 97, and presenting respective parallelepiped portions 95 of dissimilar vertical proportions. More exactly, the height of the single flow divider 90 increases progressively, and its clearance from the bearing surface 51*a* is reduced correspondingly, departing from the divider 90 nearest the first side wall 84 of the hopper 78; each flow divider 90 is also free to swing on the relative pivot 94.

Using the equipment 1 described, cigarettes 2 coming from the cigarette maker 4 can be stored in the containers 3 and supplied to the packer 5 as and when required, and in accordance with a method that will now be described.

The method in question includes a step of filling empty containers 3 with cigarettes 2 turned out by the cigarette maker 4, invoked in particular when the infeed capacity of the cigarette packer 5 drops below the output of the cigarette maker 4.

During the filling step, a proportion of the cigarettes 2 emerging from the maker 4 and advancing along the conveyor 6 toward the packer 5 will gravitate through the opening 13, ultimately filling the hopper 14, whereas the remainder will roll over the cigarettes 2 occupying the top part of the hopper 14, passing beyond and into the packer 5 (FIG. 1).

In the specific case of the example illustrated, cigarettes 2 advance on the top branch 17 of the first transport belt 15 as far as the opening 13, and on the top branch 20 of the second transport belt 18 up to the cigarette packer 5.

At the same time, empty containers 3 lying in storage on the first conveyor 27 are fed toward the hopper 14, filled one at a time with cigarettes 2 from the selfsame hopper 14, then distanced and stored (FIGS. 9 to 14).

Figure 9:
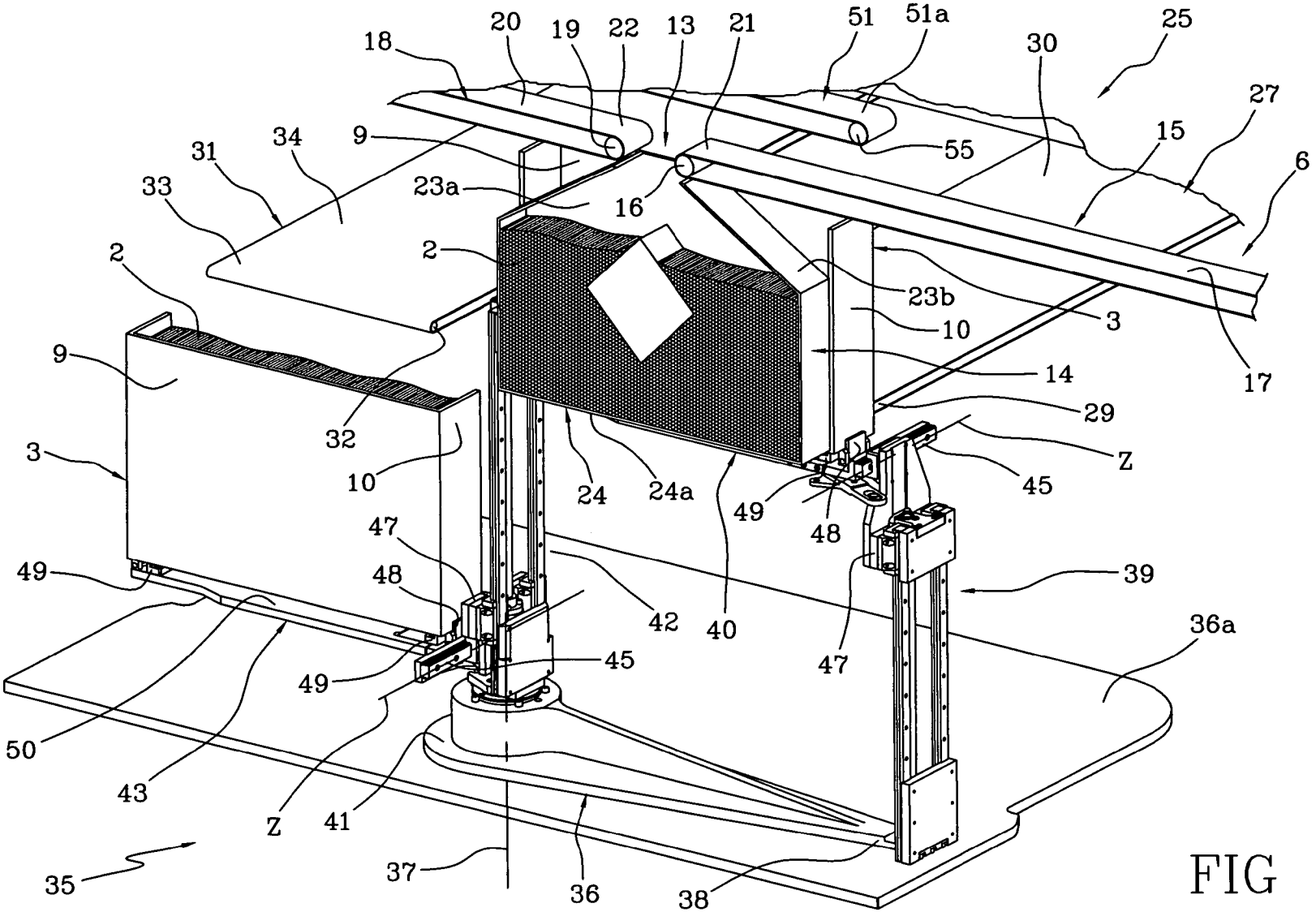
FIGS. 9, 10, 11, 12, 13 and 14 illustrate the equipment of FIG. 1, seen in respective operating positions assumed sequentially during the steps of filling and storing a container.
Figure 10:
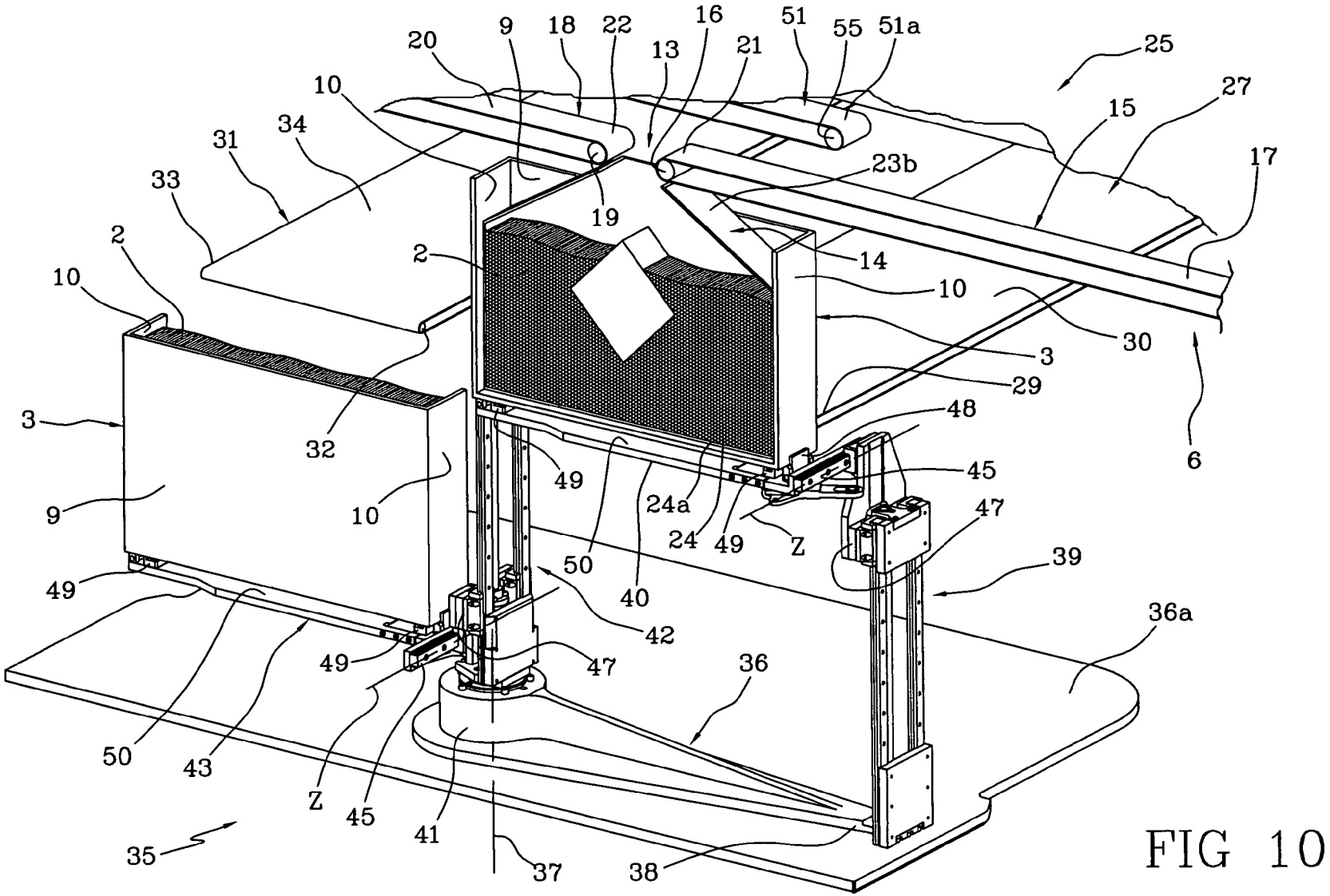

To this end, a container 3 is offered to the hopper 14 with the top opening 11 directed upwards and the auxiliary opening 12 facing the hopper 14 (container 3 on the right in FIG. 9), and placed with the bottom 8 beneath the bottom discharge opening 24 of the hopper 14, so that the hopper 14 is effectively positioned inside the container 3 (container 3 on the right in FIG. 10).

Figure 11:
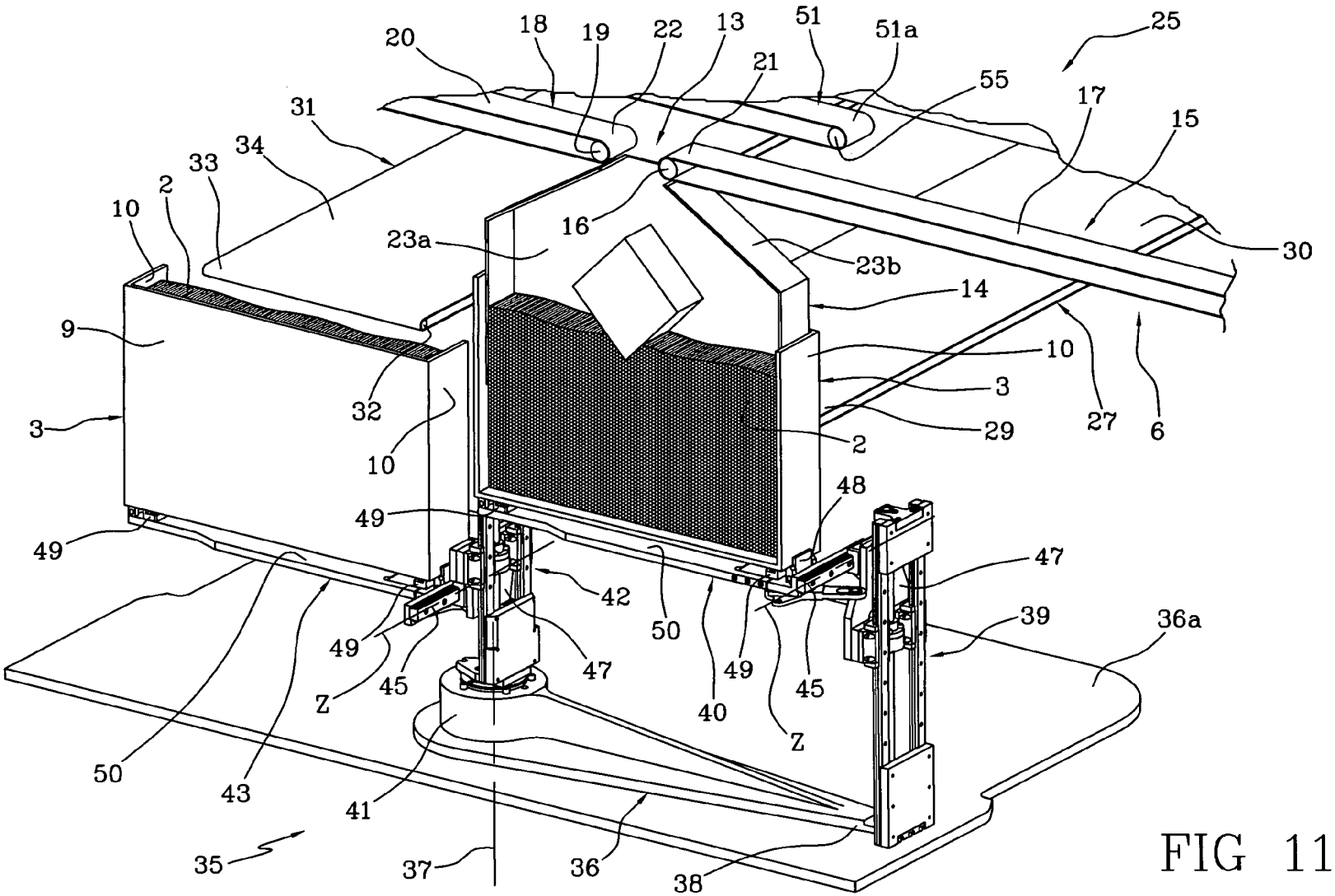

Next, the cigarettes 2 contained in the hopper 14 are released by a movement of the shutter 24*a*, and will drop through the bottom opening 24 onto the bottom 8 of the container 3, the container itself also being lowered gradually to free more space (container 3 on the right in FIG. 11).

Figure 14:
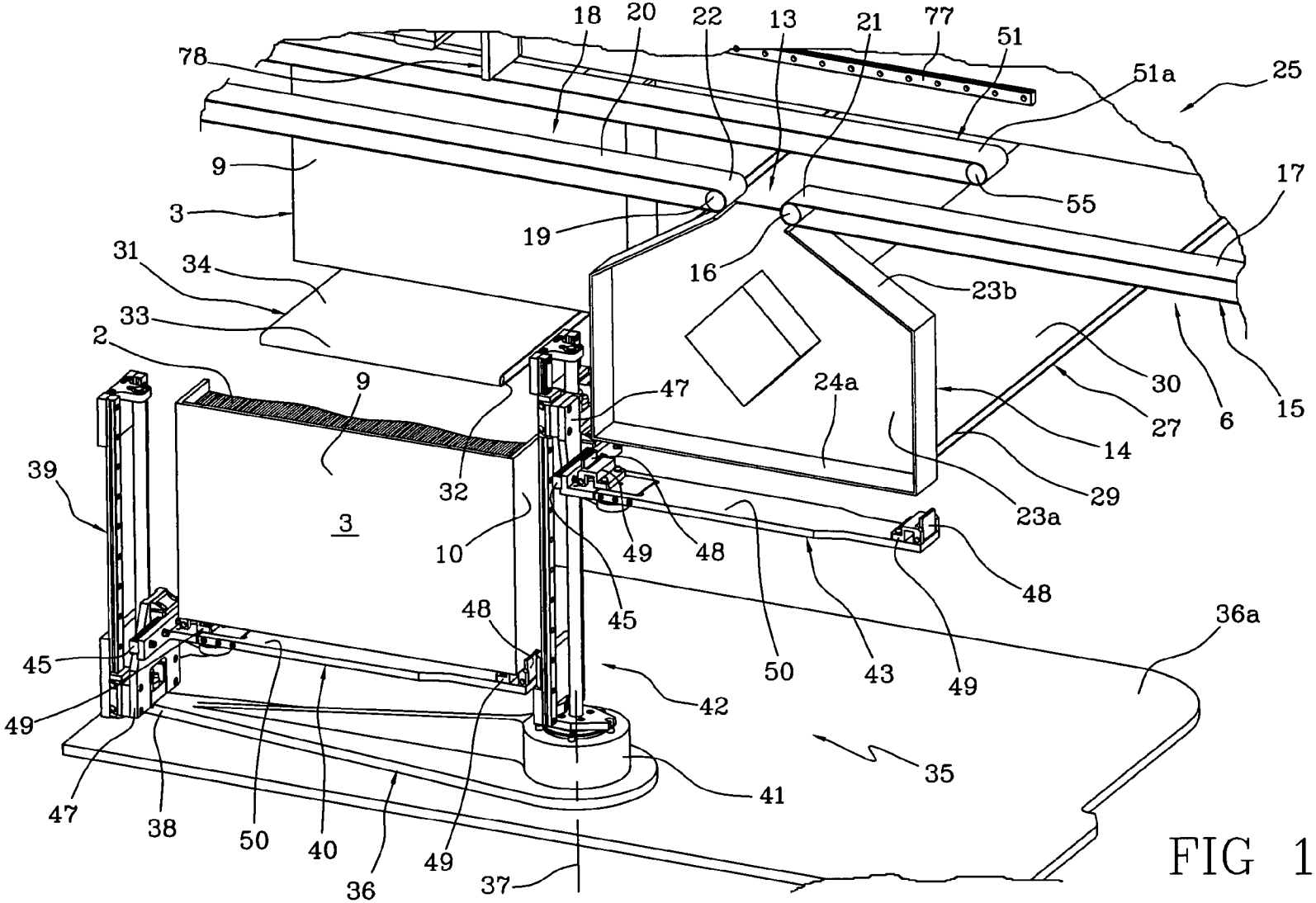

When the container 3 is full (container 3 on the right in FIG. 12), it will be transferred beneath the end 33 of the second belt conveyor 31 with the auxiliary opening 12 directed toward this same conveyor 31 (container 3 on the left in FIG. 14), elevated to the end 33 of the belt 31 (container 3 on the left in FIG. 12) and directed onto the belt 31 (container 3 on the left in FIG. 13), where it remains stored (container 3 on the left in FIG. 14).

This latter step will be effected preferably by rotating the container 3 through 180° about the aforementioned axis 37, which lies parallel to the side walls 10 and to one side of the container 3, and thereupon elevating the container.

In the case of the equipment 1 described above and illustrated in the accompanying drawings, the steps of rotating and elevating the container 3 are effected by the rotary carrier assembly 35.

More exactly, as a container 3 reaches the end 29 of the first belt conveyor 27, one of the carrier plates 40 or 43, for example the first plate 40, is elevated to a level beneath the end 29 of the conveyor so that the spacers 49, projecting beyond the first belt conveyor 27 on either side, will make contact with and support the container 3 (first position of the plate, FIG. 9).

Thereafter, the jaws 48 close on the container 3 and the linear guide member 45 slides relative to the shoe 46, moving the plate 40 into the second position beyond the end 29 of the conveyor 27 and beneath the hopper 14 (FIG. 10).

At the same time, the second plate 43 will be carrying an already full container 3 beneath the end 33 of the second belt conveyor 31, ready to be elevated to this same end 33 (FIGS. 9 and 10).

Once the shutter 24*a* of the hopper 14 has been retracted, the carriage 47 slides downward on the vertical track 39 and the first carrier plate 40 carries the container 3 into the third position as it is filled with cigarettes 2 (FIGS. 11 and 12). In the meantime, the second plate 43 is elevated with the container 3 full of cigarettes 2, bringing the bottom 8 of the container 3 into alignment with the top branch 34 of the second belt conveyor 31 (FIG. 12), whereupon the linear guide member 45 slides relative to the shoe 46, positioning the second plate 43 below the end 33 of the belt conveyor 31 and the bottom 8 of the container 3 above the end 33 of the belt 31. Thus, the end 33 of the second belt conveyor 31 slips between the plate 43 and the container 3, which rests on the spacers 49 (FIG. 13). Finally, the carriage 47 slides downward on the vertical track 39 so that the container 3 settles on the second conveyor 31, by which it is transported to a storage location with the auxiliary opening 12 directed away from the main conveyor 6 and the opening 11 directed upwards (FIG. 14).

The frame 36, together with the first vertical track 39 and the first carrier plate 40, is caused to turn on the axis 37 of rotation through 180°, bringing the container 3 into the fourth position (FIG. 14). At the same time, the second vertical track 42 and the second carrier plate 43, currently positioned higher than the first plate 40, rotate through 180° in the opposite direction and into a position of alignment with the end 29 of the first conveyor 27, ready to receive another container 3 (FIG. 14). This further empty container 3 can be offered to the hopper 14, lowered and filled, at the same time as the container 3 filled previously, carried by the first plate 40, is being rotated or elevated toward the end 33 of the second belt conveyor 31. At this point, the first plate 40 is elevated following the same steps as described previously in respect of the second plate 43.

The cycle thus described will be repeated until the cigarettes 2 that cannot be handled immediately by the packer 5 have been put into containers 3 and stored on the second conveyor 31.

The method according to the invention includes a further step of emptying full containers 3 and feeding cigarettes 2 to the packer 5, which will be invoked in particular when demand at the cigarette packer 5 exceeds output from the cigarette maker 4.

The first in the row of full containers 3 stored on the second conveyor 31 is taken up by the first arm 57, overturned and positioned above the bearing surface 51*a* of the auxiliary conveyor 51, in such a way that the top opening 11 is directed downwards and will allow the cigarettes 2 to drop onto the surface 51*a* as it advances along the predetermined feed direction X.

Figure 5:
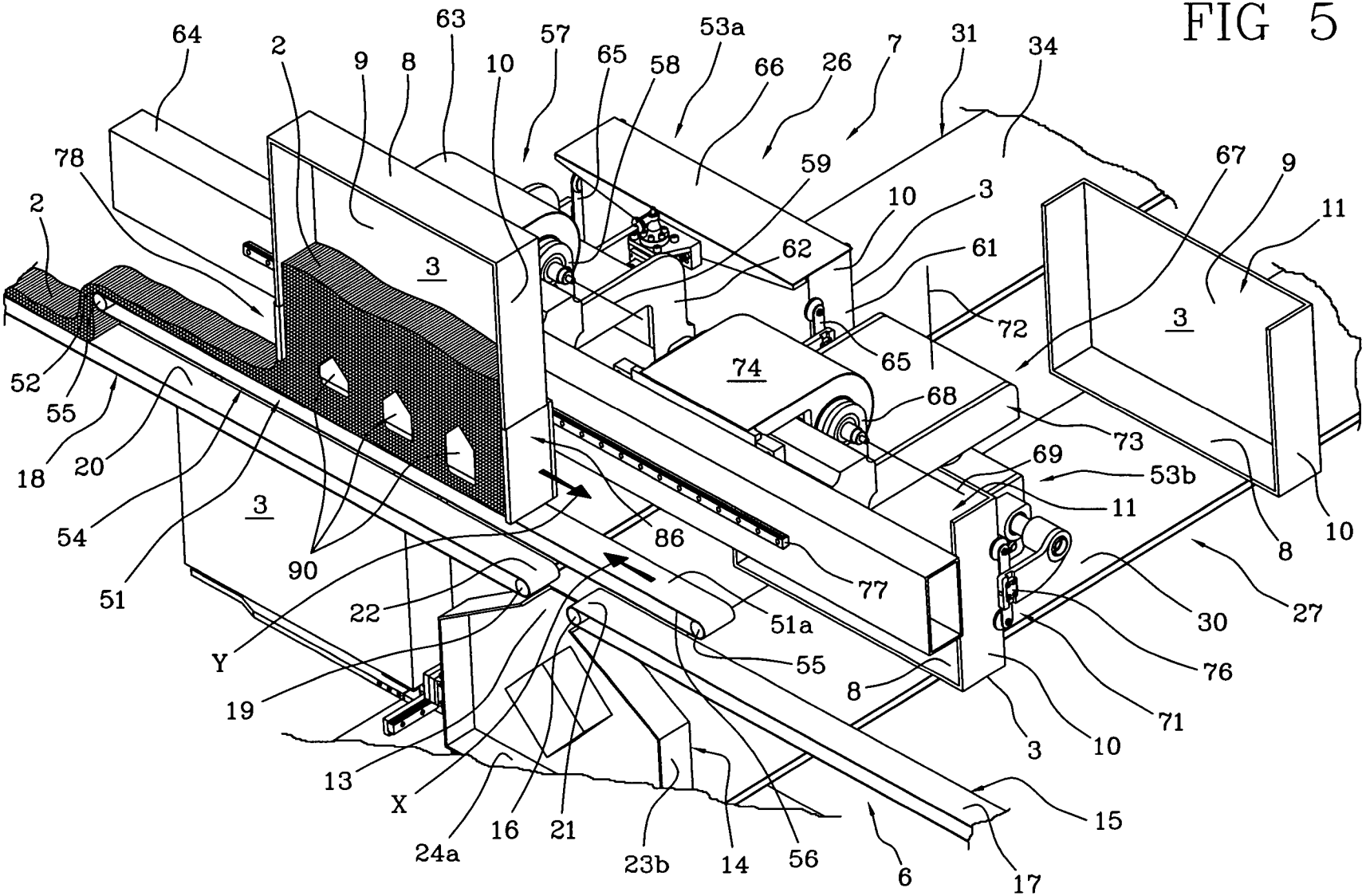

With reference in particular to the equipment 1 described above, the first arm 57 is deployed at the pick-up position illustrated in FIG. 5, the closure wall 66 is extended to close off the top opening 11 of the container 3, and the jaws 65 engage the two side walls 10 of the container 3, whereupon the arm is rotated through 180° about its horizontal axis 59 (FIG. 6) so as to position the container 3 over the hopper 78, which will be approaching the first station 79, still occupied by cigarettes 2 emptied from the previous container 3 and flowing through onto the auxiliary conveyor 51 (FIG. 7).

Figure 4:
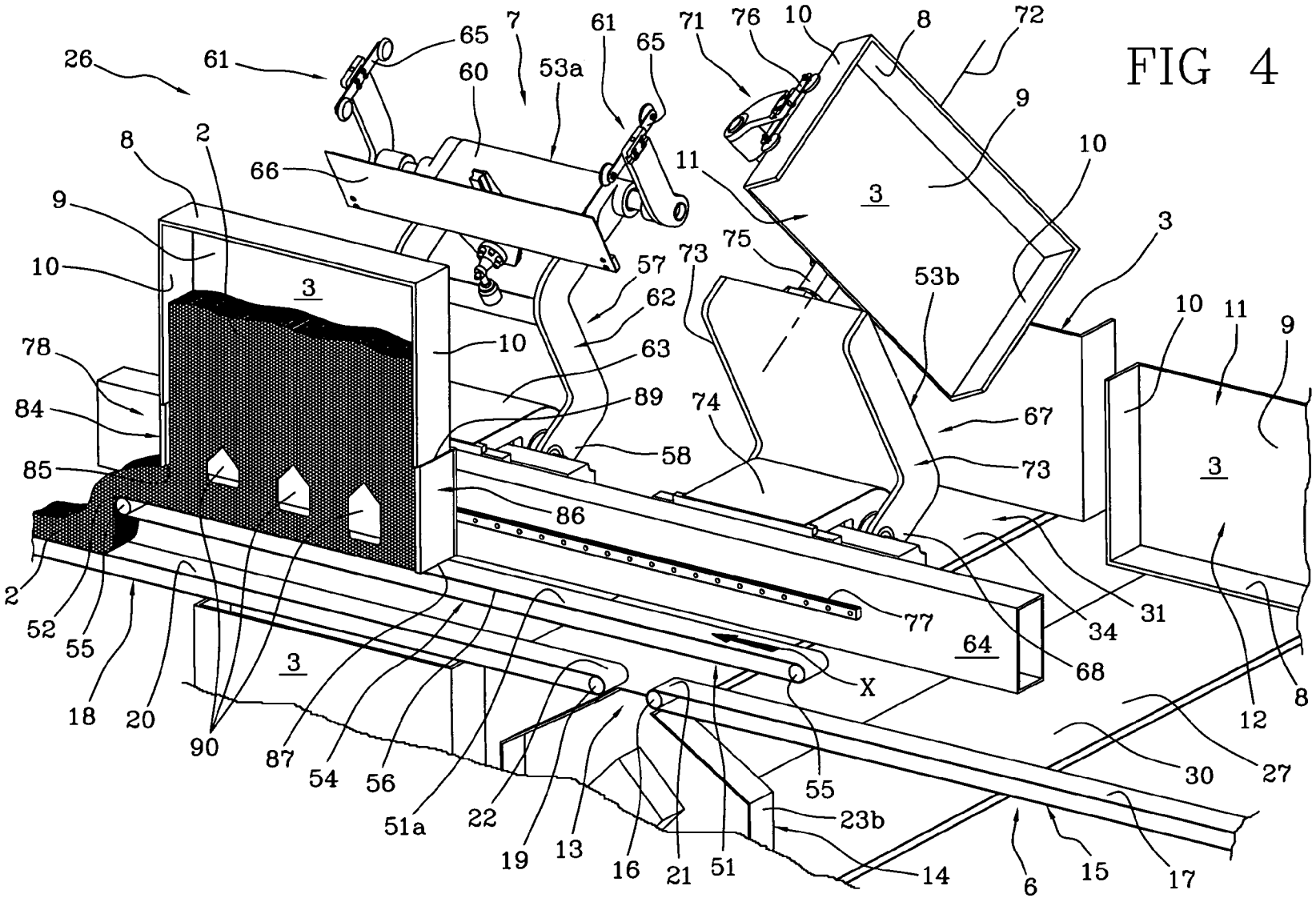
FIGS. 4, 5, 6 and 7 illustrate a portion of the equipment of FIG. 1, seen in respective operating positions assumed sequentially during the step of emptying a container.

The container 3 remains above the hopper 78 for a few moments (FIG. 1), whereupon the wall 66 is retracted and the cigarettes 2 in the container 3 are able to drop onto the cigarettes 2 still in the hopper 78, whilst the container 3 rests on the top edge 89 of the hopper 78 and the first arm 57 is withdrawn (FIG. 4). In this first emptying step, the container 3 remains stationary at the first station 79, above the advancing bearing surface 51*a* on which the cigarettes 2 are carried toward the discharge end 52.

Thereafter, in the course of a second emptying step, the hopper 78, together with the container 3 resting on the top edge, is displaced toward the second station 80 along a direction Y parallel and opposite to the feed direction X of the bearing surface 51*a* as the cigarettes 2 continue to flow through the hopper 78, now at a faster rate than during the first step, since the movement of the auxiliary conveyor 51 along the relative feed direction X is compounded by the movement of the carriage 78 in the opposite direction (FIG. 5). At the same time, the first arm 57 returns to the pick-up position.

Figure 6:
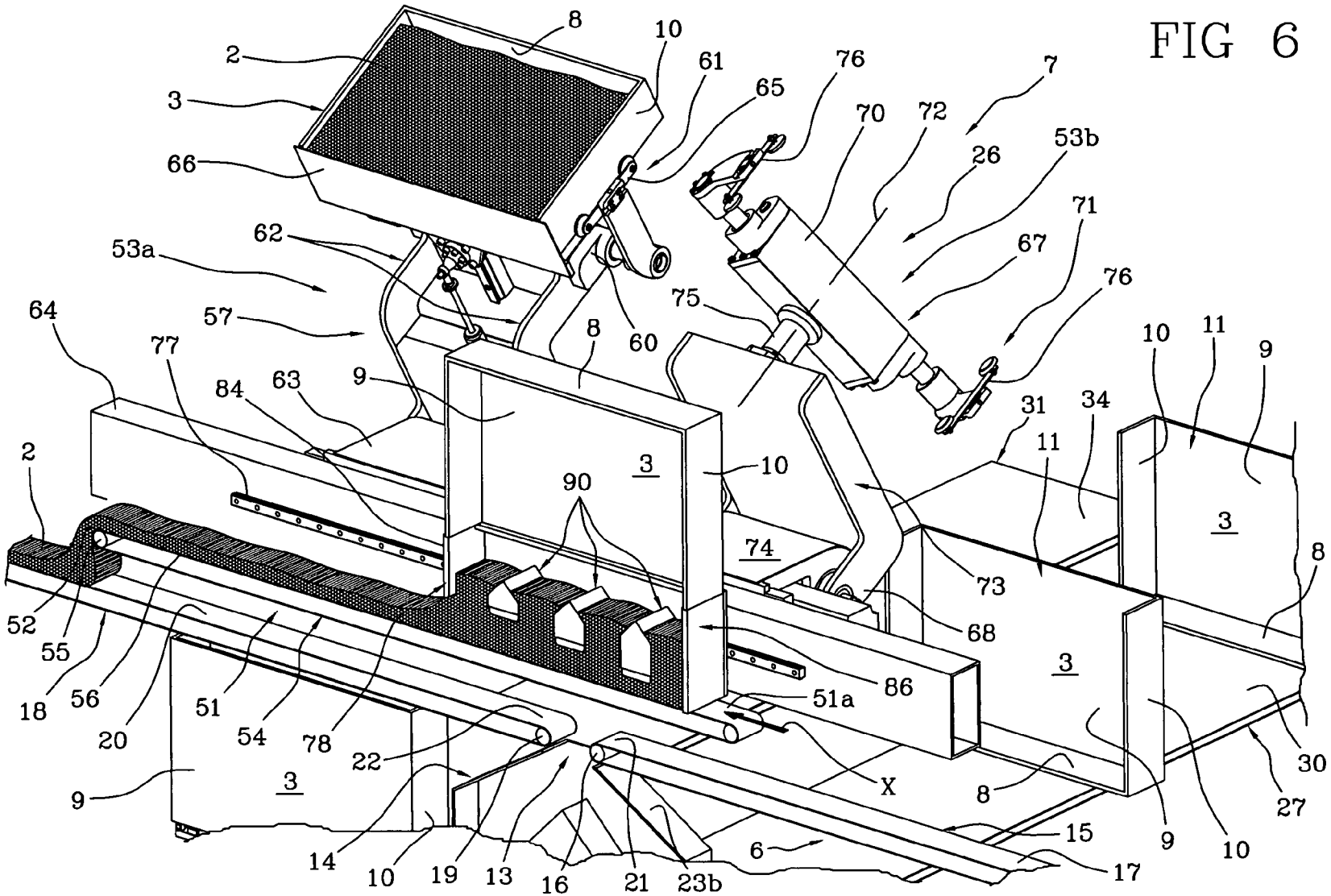

On reaching the second station 80, the hopper 78 and the container 3 remain stationary above the bearing surface 51*a*, which continues to advance, as part of a third emptying step during which the container 3 is emptied completely and another full container 3 is brought by the first arm 57 into the first station 79 (FIG. 6).

FIG. 7 illustrates a fourth emptying step in which the hopper 78, located below the container 3 and above the bearing surface 51*a* and moving as one with the container 3 during the first, second and third steps, is separated from the container 3 at the second station 80 and set in motion along a direction Y, concurrent with the feed direction X followed by the bearing surface 51*a* toward the first station 79, as the cigarettes 2 still in the hopper 78 continue to unload (FIG. 7).

On reaching the first station 79, the hopper 78 is ready to recommence the cycle (FIG. 1), whilst the empty container 3 is taken up from the second station 80 by the second arm 67 and deposited on the first conveyor belt 27 (sequence of steps shown in FIGS. 1, 4 and 5).

More exactly, the container 3 is taken up at the second station 80 by the gripper 71 of the second arm 67 and lifted a short distance to separate it from the hopper 78. Only when the hopper 78 reaches the first station 79 will the second arm 67 then rotate on its horizontal axis 69 through 180° and the gripper 71 simultaneously swivel on the axis 72 perpendicular to the horizontal axis 69 so as to position the empty container 3 with the bottom 8 resting on the first belt conveyor 27 and the auxiliary opening 12 facing toward the auxiliary conveyor 51, hence toward the loading hopper 14. Thus, the empty container 3 can either be carried by the first belt conveyor 27 toward a storage area or directed toward the hopper 14 to be refilled.

Throughout the entire sequence of emptying steps, the cigarettes 2 are separated into distinct and ordered streams by the flow dividers 90 installed in the hopper 78, which are caused by the movement of the selfsame cigarettes 2 and by the momentum of the carriage 78 itself to sway compliantly and thus prevent the cigarettes 2 from being turned skew and jamming the hopper 78.

What is claimed is:

1. A method for batch handling and transfer of tobacco products storable en masse and in ordered arrangement internally of containers, each presenting an opening by way of which it can be filled or emptied, comprising:

picking up a container filled with the tobacco products, overturning the container above a bearing surface, in such a way as to direct the opening downwards and allow the products to drop onto the surface, causing the bearing surface to advance along a predetermined feed direction parallel to the selfsame surface, and traversing the container along a direction parallel and opposite to the feed direction of the bearing surface as the container is being emptied, in such a way as to increase the rate of flow at which tobacco products are released from the container.

2. A method as in claim 1, including a first emptying step, in which the container remains stationary at a first station above the advancing bearing surface, and a second emptying step identifiable as the step of traversing the container, toward a second station.

3. A method as in claim 2, including a third emptying step, in which the container remains stationary at a second station above the advancing bearing surface.

4. A method as in claim 3, including a fourth emptying step in which a hopper, located beneath the container and above the bearing surface and set in motion as one with the container during the first, the second and the third steps, is separated from the container at the second station and set in motion along a direction concurrent with the feed direction of the bearing surface toward the first station, to the end of releasing the products still contained in the hopper.

5. A method as in claim 1, wherein the tobacco products drop through a hopper placed between the container and the advancing bearing surface, and are separated into a plurality of ordered streams by means of flow dividers mounted in the hopper.

6. A method as in claim 2, wherein an emptied container is picked up from the second station during the first step of emptying a full container at the first station.

7. A method as in claim 3, wherein a full container is supplied to the first station during the third step of emptying a partially emptied container at the second station.

8. A method as in claim 6, wherein the empty container is placed in a magazine in which empty containers are stored.

9. A method as in claim 1, wherein the full container is picked up from a magazine in which full containers are stored.

* * * * *